United States Patent [19]

Yuen

[11] 4,432,043

[45] Feb. 14, 1984

[54] COMBINED FLUORESCENT LAMP AND SPOTLIGHT

[75] Inventor: John S. Yuen, Kwun Tong Kowloon, Hong Kong

[73] Assignee: Parly Tools Manufacturing Limited, Kowloon, Hong Kong

[21] Appl. No.: 448,287

[22] Filed: Dec. 9, 1982

[30] Foreign Application Priority Data

Dec. 23, 1981 [GB] United Kingdom ..... 8138799

[51] Int. Cl.[3] ..... F21V 33/00

[52] U.S. Cl. ..... 362/184; 200/60; 362/185; 362/186; 362/200; 362/202; 362/205; 362/217; 362/223; 362/399

[58] Field of Search ..... 362/184, 185, 186, 200, 362/202, 217, 223, 205, 399; 200/60

[56] References Cited

U.S. PATENT DOCUMENTS

D. 233251 10/1974 Lowrance ..... 362/184

4,321,657 3/1982 Hoi ..... 362/184

*Primary Examiner*—Stephen J. Lechert, Jr.

*Attorney, Agent, or Firm*—Thomas E. Beall, Jr.

[57] ABSTRACT

A combined fluorescent lamp and spotlight which is simple to manufacture and assemble has a trough-shaped body member of generally rectangular section with tubular cylindrical projections at its ends and a chassis member received on the trough-shaped body member and closing the open side thereof, the chassis member mounting a bulb holder for a bulb, fluorescent tube mounting members, a printed circuit board, a switch and battery contacts such that all the electrical components requiring connection together are all provided on the chassis member which can be completely wired before being engaged on the trough-shaped body member to close the open side thereof. A cover of transparent material and of elongate arch section overlies a fluorescent tube mounted on the mounting member of the chassis member and end members, each with an aperture therethrough to receive respective ones of the tubular projections of the body portion and each have a peripheral flange overlapping the cover and the body portion and thereby retaining the cover in position on the body portion. End caps engage with integral screw threads the tubular projections of the body portion and are received each in a recess in the outer end face of the respective one of the end members thereby retaining the end members in position on the body portion. One of the end caps has a transparent end wall and a reflector therein receiving the bulb mounted in the bulb holder.

14 Claims, 9 Drawing Figures

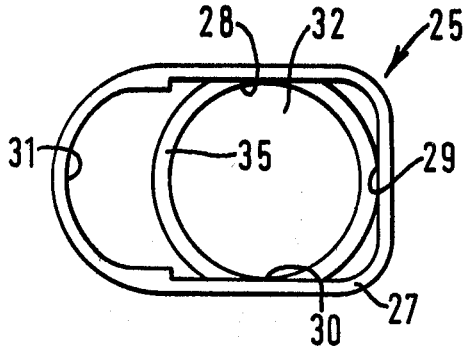
FIG. 7.
FIG. 8.
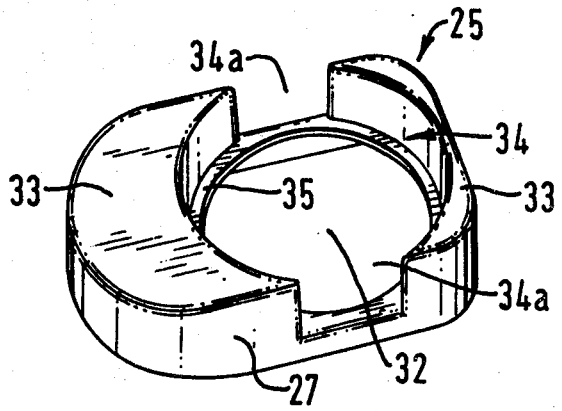
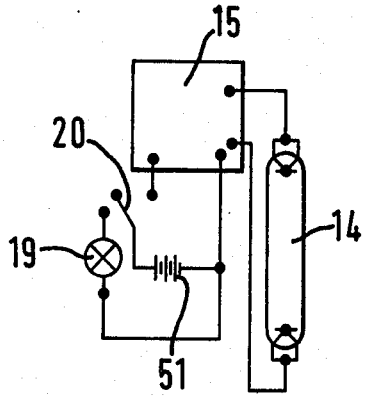
FIG. 9.

COMBINED FLUORESCENT LAMP AND SPOTLIGHT

The invention relates to combined fluorescent lamp and spotlight.

Combined fluorescent lamps and spotlights have been previously proposed and comprise an elongate body portion having a part of the periphery thereof comprising one side wall and a part of each of the front and rear walls, formed of transparent material, a chassis member mounted within the body portion and having upstanding ends between which a fluorescent tube can be mounted to provide illumination through the transparent wall, end members secured by screws passing through the end members to engage in threaded apertures in the ends of the chassis member, and a switch and printed circuit board arrangement mounted on the inside of the body member with a operating portion of the switch projecting through the body member. An outer part of one of the end members is formed with a transparent end wall and a reflector and said outer part engages with ratchet teeth in the remainder of that end member. The other end member has an aperture in its end wall through which batteries can be passed into a battery compartment within the body member, the aperture being enclosed by an end cap with a bayonet-like retaining fitting.

Such combined fluorescent lamps and spotlights have proved to be very popular but have proved to be expensive to manufacture particularly due to the difficulties of connecting wiring between the chassis member mounting the fluorescent tube, a bulb holder mounted in said one of the end members and the switch and printed circuit board arrangement mounted within the body portion. From the users point of view, it is necessary, if it is necessary to replace the fluorescent tube, to remove the end members after loosening the securing screws with a screwdriver and upon reassembly hold the various components in the correct positions while the screws are started in the threaded holes and tightened to hold the components together. The exposed screws are liable to rusting if exposed to the weather.

According to the invention a combined fluorescent lamp and spotlight has a trough-shaped body member of generally rectangular section with tubular cylindrical projections at its ends; a chassis member received on the trough-shaped body member and closing the open side thereof, the chassis member mounting a bulb holder, fluorescent tube mounting members, a printed circuit board, and a switch and battery contacts; a cover of transparent material and of elongate arch section to overlie a fluorescent tube mounted on the mounting members of the chassis member; a pair of end members each with an aperture therethrough to receive a respective one of the tubular projections of the body portion and a peripheral flange to overlap the cover and the body portion and thereby retain the cover in position on the body portion; and end caps to engage with integral screw threads the tubular projections of the body portion and to be received each in a recess in the outer end face of a respective one of the end members to retain the end members in position on the body portion, one of the end caps having a transparent end wall and a reflector therein to receive a bulb mounted in the bulb holder.

Thus all the electrical components requiring connection together can be provided on the chassis member which can be completely wired before being engaged on the trough-shaped body member to close the open side thereof. Preferably the switch is slidably mounted with respect to the chassis membber such that upon engagement of the chassis member on the body member the switch can be located so that an operating portion thereof projects through an aperture in the adjacent wall of the body member, the switch sliding to its final position with respect to the chassis member as the chassis member is finally engaged on the body member.

The cooperating integral threads on the tubular projections of the body member and the end caps obviate the need for any separate screw members to secure the end members to the body member or chassis member.

Preferably the recess in the outer end face of each end member is open at opposite sides thereof so that the end cap received therein is located within the profile of the end member but force can be applied to the circumferential face of the end cap, which circumferential face is preferably knurled or provided with other means whereby it can be gripped, so that the end cap can be readily rotated to tighten or loosen its screw threaded engagement with the tubular projection of the body portion. In its fully screwed on position each end cap preferably has its outer end face flush with the outer end face of the respective end member.

The invention is diagrammatically illustrated by way of example in the accompanying drawings, in which:

FIGS. 7 and 8 are respectively a plan view of the inner end and a perspective view of the outer end of one of two end members of the combined fluorescent lamp and spotlight of FIGS. 1 to 6; and FIG. 9 is a circuit diagram of the combined fluorescent lamp and spotlight of FIGS. 1 to 6.

Figure 1:
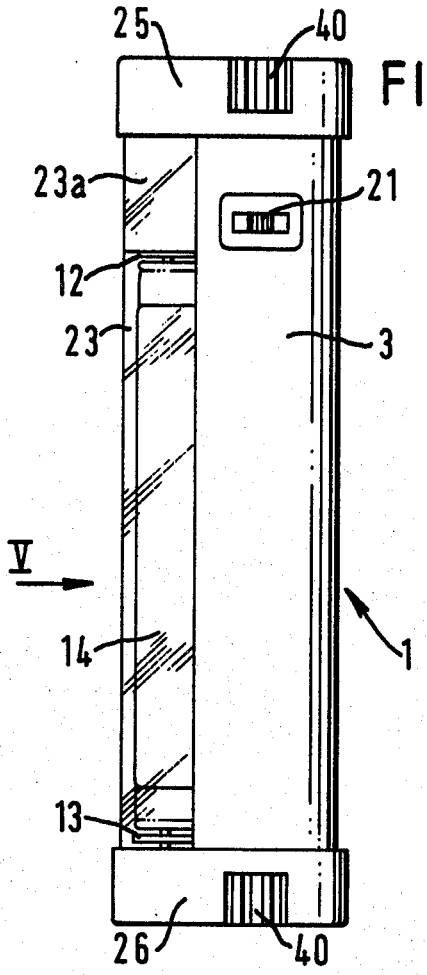
FIG. 1 is an elevation of combined fluorescent lamp and spotlight according to the invention.

Referring to the drawings, a combined fluorescent lamp and spotlight has a trough-shaped body portion 1 comprising a base wall 2 and side walls 3 and 4, an upper end wall 5 with a tubular projection 6 thereon, a projecting flange 5*a* continuing the end wall 5 and a lower end wall 7 with a tubular projection 8 thereon. The body member is formed of an opaque plastics material by injection moulding.

A chassis member 10 has a deck portion 11 with longitudinally extending side flanges depending therefrom, the side flanges being received within the open mouth of the body portion 1 and abutting shoulders 3*a*, 4*a* on the inner face of the walls 3 and 4 thereof. Flanges 12 and 13 project from the deck 11 and form holders and mount contact members 12*a*, 13*a* for a fluorescent tube 14, an extension 11*a* of the deck 11 mounts a printed circuit board 15 with circuit omponents 16 thereon, further flanges 17 and 18 mount contact members to form a bulb holder for a bulb 19 and a still further flange 9 forms with the flange 18 a groove slidably to receive a switch 20 having an operating member 21 which projects through an aperture in the side wall 3 of the body portion 1. The still further flange 9 also mounts a battery contact member 22.

An arch-shaped transparent plastics member 23 has its free longitudinal edges engaged within the side walls 3 and 4 of the body portion 1 and resting on the deck 11 of the chassis member 10 so that light from the fluorescent tube 14 can shine therethrough, an end portion 23*a* of the arch-shaped transparent member 23 having an opaque shield 24 lining its inner face so that the components 16 on the printed circuit board 15 are concealed from view.

Two end members 25 and 26 are of substantially, identical construction and only the construction of the end member 25 is described. The end member 25 has a peripheral flange 27 which is continuous at the inner end and, as can be seen in FIG. 7, has, at its inner edge, straight portions 28, 29 and 30 whereby it can be engaged over the respective end of the body portion 1 with the straight portions 28, 29 and 30 overlapping the walls 3, 2 and 4 respectively of the body portion 1 and the flange 27 also has a curved inner portion 31 to overlap the respective end of the transparent arch member 23. A circular aperture 32 in the end member 25 allows the tubular portion 6 of the body portion 1 to project therethrough and an outer end wall 33 of the end member 25 is in two parts with the two parts separated by a recess 34 with an integral annular flange 35 at the base of the recess 34. The recess 34 extends out of the sides of the end member 25 so that gaps 34*a* are formed in the outer part of the peripheral flange 27.

Figure 5:
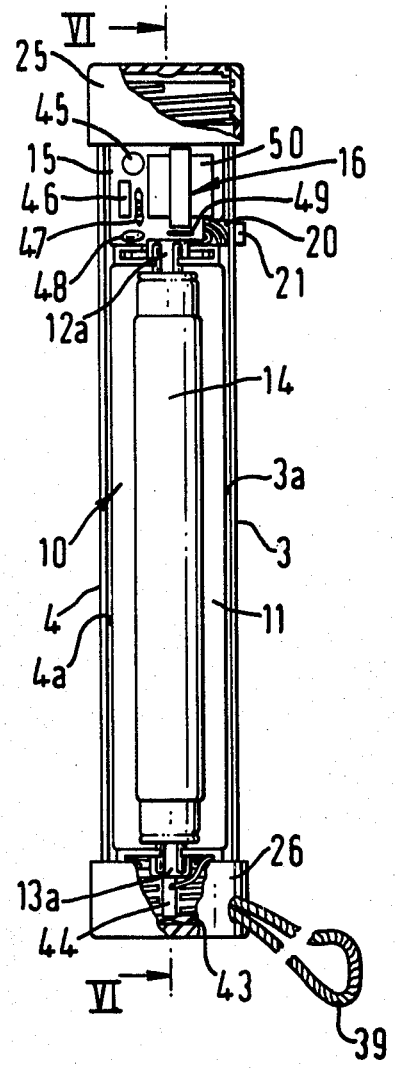
FIG. 5 is a view taken in the direction of arrow V of FIG. 1 with parts cutaway to show internal details.
Figure 6:
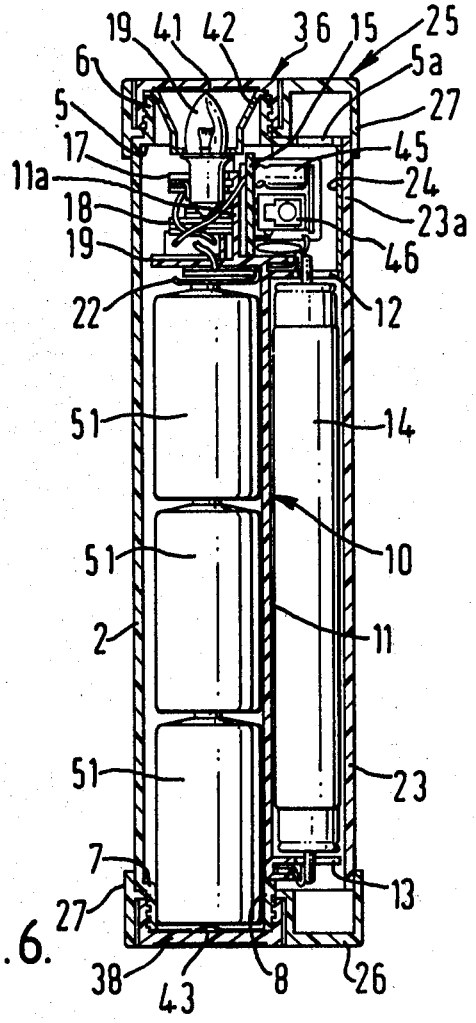
FIG. 6 is a sectional view taken on line VI—VI of FIG. 5.

After the end member 25 has been engaged over the respective end of the body portion 1 so that the peripheral flange 27 retains the arch member 23 in its engaged position on the body portion 1, thereby also securing the chassis member 10 in position, an end cap 36 is engaged in the recess 34 by screwing it thereinto so that a screw thread on the inner face of a skirt of the cap 36 engages a screw thread on the tubular projection 6 of the body portion. In its fully screwed in position, the free end of the skirt of the cap 36 abuts the flange 35 and the outer end face of the cap 36 is flush with the two parts of the outer end face 33 of the end member 25. The end member 26 cooperates with an end cap 38 in similar manner to the cooperation of the end cap 36 with the end member 25. The end member 26 has an aperture in its peripheral flange 27 at a position outwardly of the curved portion 31, in which aperture the ends of a flexible loop 39, FIG. 5, can be engaged to provide a carrying handle.

In its engaged, screwed in position, the end cap 36 has knurled or grooved portions 40 of its periphery accessible through the gaps 34*a* in the peripheral wall 27 formed by the recess 34 to enable it to be gripped and rotated to cause the screw thread thereon to cooperate with the screw thread on the tubular extension 6 of the body portion 1. The end cap 36 has a transparent end wall 41 and on its inner face mounts a reflector 42, in which reflector 42 the bulb 19 is engaged in the fully assembled position. The end cap 38 has a copper contact disc 43 lining its end wall and a copper strip 44, FIG. 5, extends from the contact member 13*a* on the flange 13 of the chassis member 11 along a groove in the screw thread of the tubular portion 8 of the body portion 1 to make electrical contact with the copper contact disc 43.

The components 16 on the printed circuit board 15 comprise a capacitor 45, a transistor 46, a resistor 47, a mica capacitor 48, a ceramic capacitor 49 and a transformer 50. A reflecting layer is provided on the outer face of the deck 11 of the chassis member 10.

Batteries 51, preferably three 1.5 volt UM-2 batteries, are received within the body portion 1 and retained therein by the end cap 38.

In manufacture the printed circuit board 15 mounting the components 16, comprising the items 45 to 50 listed above, is located on the chassis member 11 and wire connections are made therefrom to the fluorescent tube contact members on the projecting flanges 12 and 13 to the battery contact 22, to the bulb contacts on the flanges 17 and 18 and to the switch 20. The chassis member 10 is then engaged in the body portion 1 with the switch 20, which is mounted between the two parallel flanges 18 and 9, in an extended position such that its switch member 21 can be engaged in the aperture in the side wall 3 of the body portion 1. The switch 20 will slide to a retracted position as the chassis member 10 is moved into full engagement with the open upper part of the trough-shaped body portion 1. The fluorescent tube 14 can then be engaged on the chassis member 10 by engaging the two pins, which it has at each end, in triangular slots in the projecting flanges 12 and 13 and then rotating the tube 14 about its longitudinal axis to engage the contact pins with the fluorescent tube contact members 12*a*, 13*a* and to lock the tube in position. The bulb 19 can then be inserted through the outer end of the tubular projection 6 of the body member 1 to engage in the bulb holder formed by the contact members on the flanges 17, 18 of the chassis member 10. The arch member 23 with the opaque liner 24 engaged therein can then be placed in position over the fluorescent tube 14 and the printed circuit components 16 and the copper strip 44 located so as to lie along the groove in the tubular projection 8. The end members 25 and 26 can then be engaged over the ends of the assembled body portion 1, chassis member 10 and arch member 23 so that the peripheral flanges 27 of the end members 25 and 26 retain the components of the assembly in position and the end caps 36 and 38 can be screwed onto the tubular projections 6 and 8 of the body portion 1. The combined fluorescent lamp and spotlight is thus completely assembled and is ready for the purchaser to remove the end cap 38 and insert the batteries 51.

Figure 4:
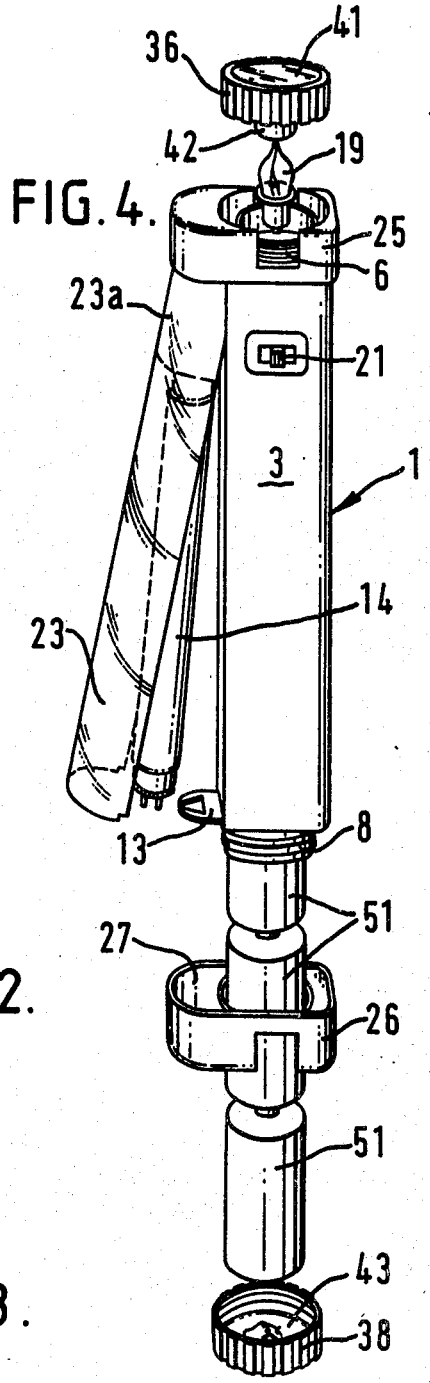
FIG. 4 is a partially exploded view of the lamp of FIG. 1.
Figure 2:
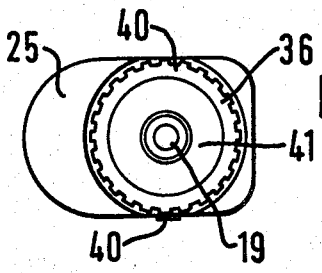
FIG. 2 is a plan view corresponding to FIG. 1.
Figure 3:
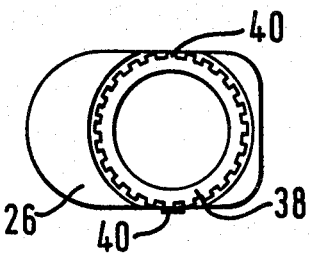
FIG. 3 is a underneath plan view corresponding to FIG. 1.

FIG. 4 shows that the fluorescent tube 14 can be replaced by removing only the lower end member 26 and hinging the arch member 23 away from the body portion 1 and also that the bulb 19 can be replaced merely by removing the end cap 36.

What is claimed is:

1. A combined fluorescent lamp and spotlight, comprising in combination:

a body member of generally rectangular section with one open side and having tubular cylindrical projections with screw threads at the ends of said body member;

a chassis member received on said body member and closing said open side thereof, said chassis member having mounted thereon a bulb holder, fluorescent tube mounting members, electrical circuit components, a switch and battery contacts;

a cover of transparent material and of elongate arch section to overlie a fluorescent tube mounted on said tube mounting members of said chassis member;

a pair of end members each formed with an aperture therethrough, each of which said apertures receives a respective one of said tubular projections of said body member, and a peripheral flange to overlap said cover and thereby retain said cover in position on said body member; and end caps with screw threads to engage with said screw threads of said tubular projections of said body member and to engage a respective one of said end members to retain said end members in position on said body member, one of said end caps having a transparent end wall and a reflector therein to receive a bulb mounted in said bulb holder.

2. A combined fluorescent lamp and spotlight as claimed in claim 1, wherein said switch has an operating portion and is slidably mounted with respect to said chassis member such that upon engagement of said chassis member on said body member said switch operating portion projects through an aperture in the adjacent wall of said body member, and said switch sliding to its final position with respect to said chassis member as said chassis member is finally engaged on said body member.

3. A combined fluorescent lamp and spotlight as claimed in claim 1, wherein each of said end members has a recess in the outer end face open at opposite sides thereof so that said end cap is received therein and located within the profile of said end member so that force can be applied to the circumferential face of said end cap so that said end cap can be readily rotated to tighten or loosen its screw threaded engagement with said tubular projection of said body member.

4. A combined fluorescent lamp and spotlight as claimed in claim 3, wherein said circumferential face of each said end cap is provided with means whereby it can be securely gripped.

5. A combined fluorescent lamp and spotlight as claimed in claim 4, wherein, in its fully screwed on position, each said end cap has its outer end face flush with the outer end face of the respective said end member.

6. A combined fluorescent lamp and spotlight as claimed in claim 3, wherein, in its fully screwed on position, each said end cap has its outer end face flush with the outer end face of the respective said end member.

7. A combined fluorescent lamp and spotlight as claimed in claim 1, wherein said chassis member and said body member form between them an elongated battery chamber; said cover and said chassis member forming between them an elongated chamber for the fluorescent tube, which chamber is substantially coextensive with and parallel to the battery chamber.

8. A combined fluorescent lamp and spotlight as claimed in claim 7, wherein said cover and said body member form between them an electrical component chamber receiving therein a portion of said chassis member having thereon said bulb holder, and electrical circuit components at the one end of and apart from said battery and fluorescent tube chambers; said cover being opaque adjacent said chamber between cover and body member.

9. A combined fluorescent lamp and spotlight as claimed in claim 8, wherein said switch has an operating portion and is slidably mounted with respect to said chassis member such that upon engagement of said chassis member on said body member said switch operating portion projects through an aperture in the adjacent wall of said body member, and said switch sliding to its final position with respect to said chassis member as said chassis member is finally engaged on said body member.

10. A combined fluorescent lamp and spotlight as claimed in claim 9, wherein each of said end members has a recess in the outer end face open at opposite sides thereof so that said end cap is received therein and located within the profile of said end member so that force can be applied to the circumferential face of said end cap so that said end cap can be readily rotated to tighten or loosen its screw threaded engagement with said tubular projection of said body member.

11. A combined fluorescent lamp and spotlight as claimed in claim 10, wherein said circumferential face of each said end cap is provided with means whereby it can be securely gripped, and wherein, in its fully screwed on position, each said end cap has its outer end face flush with the outer end face of the respective said end member.

12. A combined fluorescent lamp and spotlight, comprising in combination:

a body member molded in one piece of synthetic resin, and having a channel shaped elongated central portion and opposite end tubular cylindrical projections with screw threads;

a chassis member received within the channel shape of said body member and having thereon a bulb holder at one end, opposed fluorescent tube holders at its opposite ends for mounting a fluorescent tube within and parallel to said body member, battery contact means for making electrical contact with the opposite ends of at least one battery, and electrical circuit means interconnecting said bulb holder, said fluorescent tube holder, said battery contacts and including switch means for selectively energizing said bulb contacts and said fluorescent tube holder;

a cover generally of transparent material and of elongate arch section to overlie a fluorescent tube mounted on said tube mounting member of said chassis member and to enclose, with said body member, said chassis member;

end means, including screw threads mating respectively with the screw threads of said tubular cylindrical projections for closing the opposite ends of said body member and holding said chassis member and cover securely to said body member to constitute the sole means for securing said cover, chassis member and body member together; and said body member including aperture means for providing access to operate said switch means, and said chassis member providing the sole means for supporting electrical components of the combination.

13. A combined fluorescent lamp and spotlight as claimed in claim 12, wherein one of said end means includes a transparent portion adjacent said bulb holder, when assembled, and a reflector mounted thereon to surround a bulb in said bulb holder, when assembled.

14. A combined fluorescent lamp and spotlight as claimed in claim 13, wherein said chassis member and said body member together form an elongated battery chamber extending parallel to and on the opposite side of said chassis member from a fluorescent tube chamber as defined between the fluorescent tube holder; and wherein the other of said end means closes, when assembled, the battery chamber and, when removed, provides replacement access to said battery chamber.

* * * * *